US010668344B1

(12) United States Patent
Woodward

(10) Patent No.: US 10,668,344 B1
(45) Date of Patent: Jun. 2, 2020

(54) SWING TECHNIQUE TRAINING SYSTEM AND METHOD OF USE

(71) Applicant: Joe Woodward, Glendora, CA (US)

(72) Inventor: Joe Woodward, Glendora, CA (US)

( * ) Notice: Subject to any disclaimer, the term of this patent is extended or adjusted under 35 U.S.C. 154(b) by 0 days.

(21) Appl. No.: 16/224,064

(22) Filed: Dec. 18, 2018

(51) Int. Cl.
*A63B 69/00* (2006.01)

(52) U.S. Cl.
CPC .. *A63B 69/0002* (2013.01); *A63B 2069/0008* (2013.01)

(58) Field of Classification Search
CPC .... A63B 69/38–385; A63B 2069/0008; A63B 69/0002
USPC ..... 473/451, 453
See application file for complete search history.

(56) References Cited

U.S. PATENT DOCUMENTS 2,171,376 A * 8/1939 Smith ..... A61F 13/12 128/97.1
4,655,452 A * 4/1987 Huerstel ..... A63B 69/0002 473/453
5,226,645 A * 7/1993 Stewart ..... A63B 69/0002 473/453
7,377,866 B2 * 5/2008 Van Nguyen ..... A63B 59/51 473/566
7,959,528 B1 * 6/2011 Wilkes ..... A63B 69/0002 473/451
8,266,719 B2 * 9/2012 Duby ..... A41D 19/01582 2/161.1
2010/0270247 A1 * 10/2010 Durham ..... A47L 23/205 211/85.3

* cited by examiner

*Primary Examiner* — Laura Davison
(74) *Attorney, Agent, or Firm* — Richard Eldredge

(57) ABSTRACT

A swing technique training apparatus having a main body made from a first adjacent loop having first end and a second end, a second adjacent loop having a first end and a second end, and a fastener securing the first ends of the first and second adjacent loops together; and at least one adjustable connecting strap attached to the main body.

2 Claims, 1 Drawing Sheet

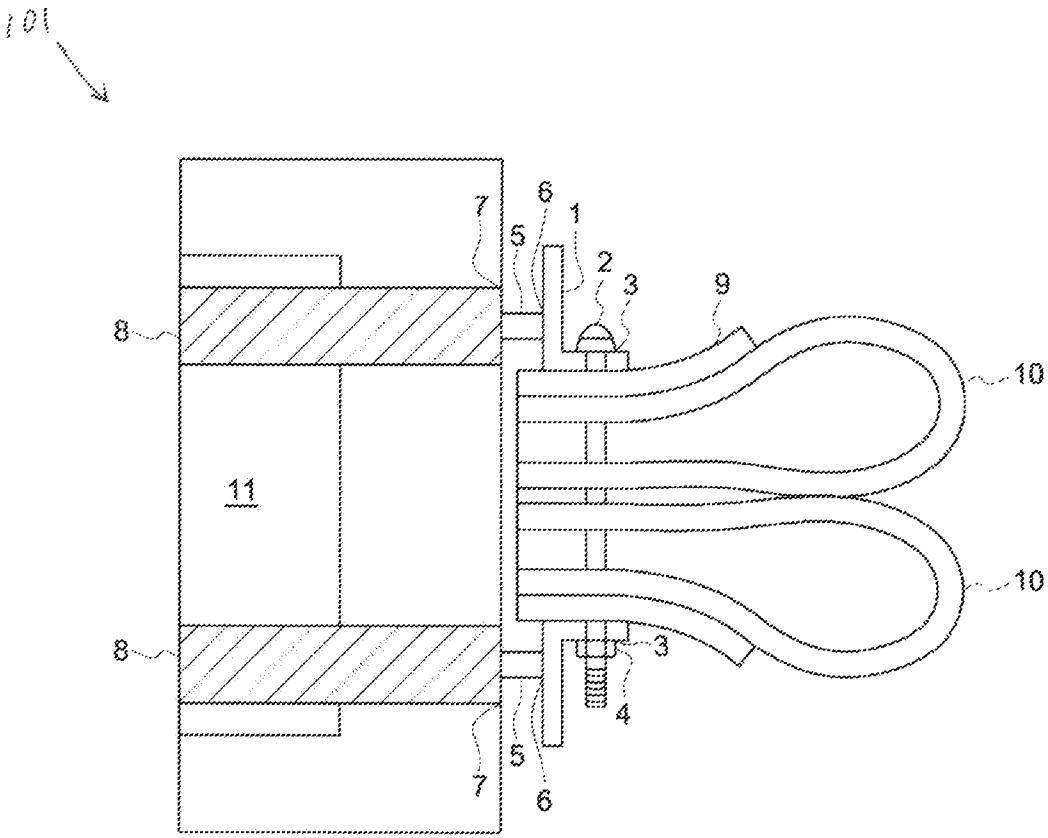
101
1
2
3
4
5
6
7
8
9
10
11

SWING TECHNIQUE TRAINING SYSTEM AND METHOD OF USE

BACKGROUND

1. Field of the Invention

The present invention relates generally to a swing technique training system and methods of use. More specifically, the invention is related to a system and method for a person to train their muscle memory for the ideal baseball or softball swing to make powerful contact with a ball using a baseball bat and a training apparatus.

2. Description of Related Art

Systems and methods for swing technique for baseball and softball are well known in the art. Batting cages have long been a preferred method for training for swing technique, allowing a person or athlete to hit repetitive, consistently thrown balls. In addition, other training methods include video taping for feedback or weight-room exercises to strengthen targeted muscle structures.

One of the problems commonly associated with the above process is the limited use. In each of these cases, the training techniques rely on a third party eye, whether through a video tape or a coach or rely on repetition without immediate feedback on swing placement.

Although great strides have been made in the area of swing technique training systems and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIG. 1 is a simplified schematic of a system and method of the present invention in accordance with the preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods for swing technique training. Unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to FIG. 1, the present invention is depicted in the preferred embodiment having two adjacent loops 10 formed by bending an elongated strip and matching a set of ends of the elongated strip which are attached via connecting straps 8 to a pole or stand. The adjacent loops 10 are secured at one end via a rod or elongated screw 3 having a screw head 2 and a tightening fastener 4 which pinches one side of the adjacent loops together vertically. The adjacent loops 10 are further stabilized by two L-shaped brackets 1 which are then secured to the connecting straps 8 via a set of connecting fasteners 5. The loops 10 are reinforced with an additional top and bottom layer 9 which forces the looped end of the loops to come together without being restricted in moving apart. Additionally, a pad 11 is used to help secure the connecting straps 8 in place onto a rod, pole or stand.

The connecting straps 8 allow for a user to adjust the height at which the training apparatus is located for optimally customized training. Additionally, the connecting straps 8 are adjustable in diameters so as to allow a user to attach the apparatus 101 to any suitable pole or stand.

It is contemplated that the adjacent loops 10 may be comprised of a thick, bendable rubber such as tire material. It is anticipated that the loops 10 may be comprised of any material suitable to bending but also facilitating a "stick" of a baseball bat or other swing device including but not limited to silicones, rubbers or other weather-proof and sturdy material that can withstand repeated blows.

A user will hold a baseball bat or other device suitable for swinging and swing the baseball bat aiming to make contact between the adjacent loops 10 so that the baseball bat sticks in between the adjacent loops 10 near the vertical rod 3.

The swing technique training apparatus 101 is a mechanical device configured to simulate the blow of a wooden or metal club to a vertically standing object to develop muscle coordination. The swinging motion and subsequent sticking of the swinging device or baseball bat is a simulation of striking a tree with an axe to build strength, power, and the right technique. The sticking and contact point at the middle of the rod 3 inside the adjacent loops 10 offers immediate physical feedback to the user, training the muscles to know when the right swing has been performed.

The sticking effect created by the adjacent loops 10 is an important advantage to swing technique training in that when a user hits the training apparatus 101, he or she will receive immediate feedback on the power and placement of the swing motion and allow the user to feel of the squaring up to a ball and practice over and over again developing correct muscle memory.

The swing technique training apparatus allows a user to learn by feel and repetition the proper technique, muscle memory, and mechanics of a swing motion. This helps athletes to consistently make good contact with a ball and be successful.

It is anticipated that the swing technique training apparatus 101 may be used to train for the correct swing of a baseball bat or softball bat. Additionally, the apparatus 101 may be used to train for any type of swinging motion required in a sport such as tennis or other. Alternatively, the apparatus may be used to train for muscle building exclusively or for a work-related task.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A swing technique training apparatus comprising:

a main body comprising:

a first adjacent elastomeric loop having first end and a second end;

a second adjacent elastomeric loop having a first end and a second end, the first adjacent elastomeric loop is adjacent to the second adjacent elastomeric loop;

a first reinforcement layer positioned against the first adjacent elastomeric loop;

a second reinforcement layer positioned against the second elongated elastomeric loop;

a first L-shaped stabilization bracket positioned adjacent to the first reinforcement layer;

a second L-shaped stabilization bracket positioned adjacent to the second reinforcement layer;

a rod secured to both the first L-shaped stabilization bracket and the second L-shaped stabilization bracket, the rod extending through both the first adjacent elastomeric loop and the second elastomeric loop; and a first fastener secured to the first L-shaped stabilization bracket and a second fastener secured to the second L-shaped stabilization bracket; and a first adjustable connecting strap attached to the main body via the first fastener; and a second adjustable connecting strap attached to the main body via the second fastener;

wherein the first adjustable connecting strap and the second adjustable connecting strap are configured to secure the swing technique training apparatus to a pole or stand.

2. The swing technique training apparatus of claim 1, further comprising:

a stabilizing pad attached to the first adjustable connecting strap and the second adjustable connecting strap to prevent the first adjustable connecting strap and the second adjustable connecting strap from slipping up or down the pole or stand.

* * * * *